US006360966B1

(12) United States Patent
Wang

(10) Patent No.: US 6,360,966 B1
(45) Date of Patent: Mar. 26, 2002

(54) ROTARY SPRINKLING HEAD STRUCTURE OF SPRINKLING GUN

(76) Inventor: Gary Wang, 5775 Jurupa St., Ontario, CA (US) 91761

( * ) Notice: Subject to any disclaimer, the term of this patent is extended or adjusted under 35 U.S.C. 154(b) by 0 days.

(21) Appl. No.: 09/618,034

(22) Filed: Jul. 17, 2000

(51) Int. Cl.[7] ..... B05B 3/00; B05B 3/02; B05B 3/04

(52) U.S. Cl. ..... 239/225.1; 239/230; 239/240; 239/241

(58) Field of Search ..... 239/225.1, 240, 239/242, 255, 261, 241, 243, 245, 246, 248, 249, 230

(56) References Cited

U.S. PATENT DOCUMENTS 4,660,766 A * 4/1987 Nelson et al. ..... 239/264
4,971,256 A * 11/1990 Malcolm ..... 239/230
4,986,474 A * 1/1991 Schisler et al. ..... 239/206
5,058,806 A * 10/1991 Ruper ..... 239/205
5,288,022 A * 2/1994 Sesser ..... 239/205

* cited by examiner

*Primary Examiner*—Henry C. Yuen
*Assistant Examiner*—Davis Hwu
(74) *Attorney, Agent, or Firm*—Bacon & Thomas, PLLC

(57) ABSTRACT

A rotary sprinkling head structure of a sprinkling gun including a gun body, an anti-detachment ring, an inner cap, and a rotary cap. The front end of the sprinkling head of the gun body is disposed with a variable water discharging head and an outer stop slope is adjacent to a rear side of the variable water discharging head. Several water exits are formed behind the outer stop slope and a slope guide face is formed behind the water exits. An anti-detachment ring groove is formed behind the slope guide face. An adjusting outer thread is formed at the rear end of the sprinkling head and several annular engaging ribs are formed on the outer circumference of the rear section of the inner cap.

5 Claims, 2 Drawing Sheets

ROTARY SPRINKLING HEAD STRUCTURE OF SPRINKLING GUN

BACKGROUND OF THE INVENTION

The present invention relates to a rotary sprinkling head structure of sprinkling gun, in which an anti-detachment ring is fitted into an anti-detachment ring groove formed on the outer circumference of the sprinkling head of the gun body so that it is easier to install the anti-detachment ring. The sprinkling head of the gun body and the inner cap as well as the rotary cap are all made of plastic by integral injection molding. Therefore, the processing time is shortened and mass-production is possible to lower cost. The anti-detachment ring can be truly fitted into the anti-detachment ring groove without detachment and the ratio of good product is high.

FIG. 1 shows a conventional rotary sprinkling head structure of an existent sprinkling gun, including a gun body 10, a rotary cap 20 and a stop ring 30. The front end of the sprinkling head of the gun body 10 is disposed with a nail head-like variable water discharging head 11. A rearward diverging outer stop slope 12 is adjacent to rear side of the variable water discharging head 11. A water exit 13 is formed behind the outer stop slope 12. A projecting and inclined engaging guide face 14 is formed behind the water exit 13. A slide section 15 and an adjusting outer thread 16 are formed on the rear section of the sprinkling head. The rotary cap 20 is made of metal by milling. The outer rear section of the rotary cap 20 is formed with a bulge rotary section 21. The rear end of the rotary cap 20 is formed with a receptacle 22. An adjusting inner thread 23 is formed in front of the receptacle 22. A stop ring groove 24 is formed at middle section of the rotary cap 20. The front opening of the rotary cap 20 is formed with an outward diverging water discharging slope 25. A water sealing section 26 with unified smaller diameter is adjacent to rear side of the water discharging slope 25. A rearward diverging inner stop slope 27 is adjacent to the rear side of the water sealing section 26.

When assembled, referring to FIG. 2, a specific tool is used to place the stop ring 30 into the stop ring groove 24 of the rotary cap 20. Then the rotary cap 20 is fitted onto the front end of the gun body 10. When fitted, a certain force is applied to the rotary cap 20 so as to compress the stop ring 30 and make the stop ring 30 forcedly pass through the engaging guide face 14 of the gun body 10. Then the adjusting inner thread 23 of the rotary cap 20 is screwed onto the adjusting outer thread 16 of the gun body 10 with the stop ring 30 attaching to the slide section 15 of the gun body 10.

The above conventional structure has some shortcomings as follows:

1. The stop ring 30 must be installed into the stop ring groove 24 of the rotary cap 20 with a specific tool. In addition, when installed, it is impossible to see the interior of the rotary cap 20 so that it is difficult to assemble the sprinkling head.
2. The rotary cap 20 is made of metal by milling. The processing procedure is time-consuming so that it is impossible to mass-produce the sprinkling head and the manufacturing cost is high.
3. The stop ring groove 24 of the rotary cap 20 is formed by milling. The milling measure has poor precision and often leads to large error. Therefore, the stop ring 30 can be hardly truly installed and tends to detach from the stop ring groove 24. In the case of untrue installation, the sprinkling gun will be a defective one which cannot normally function.

SUMMARY OF THE INVENTION

It is therefore a primary object of the present invention to provide a rotary sprinkling head structure of sprinkling gun, in which an anti-detachment ring is fitted into an anti-detachment ring groove formed on the outer circumference of the sprinkling head of the gun body so that it is easier to install the anti-detachment ring.

It is a further object of the present invention to provide the above rotary sprinkling head structure of sprinkling gun, in which the sprinkling head of the gun body and the inner cap as well as the rotary cap are all made of plastic by integral injection molding. Therefore, the processing time is shortened and mass-production is possible to lower cost.

It is a further object of the present invention to provide the above rotary sprinkling head structure of sprinkling gun, in which the sprinkling head of the gun body is made of plastic by integral injection molding. Such production measure has good precision and small error. Therefore, the anti-detachment ring can be truly fitted into the anti-detachment ring groove without detachment and the ratio of good product is high.

The present invention can be best understood through the following description and accompanying drawings wherein:

DETAILED DESCRIPTION OF THE PREFERRED EMBODIMENT

Figure 1:
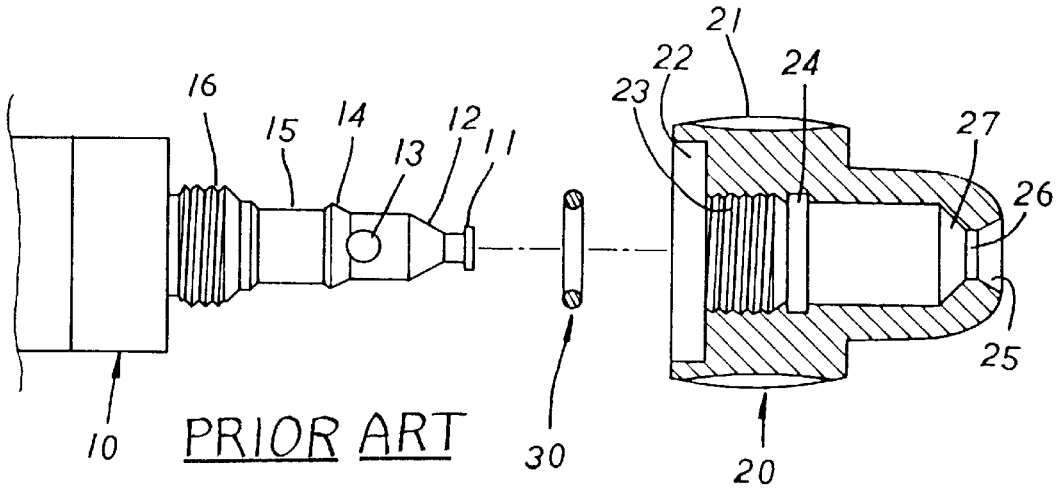
FIG. 1 is a sectional exploded view of a conventional rotary sprinkling head of sprinkling gun.
Figure 2:
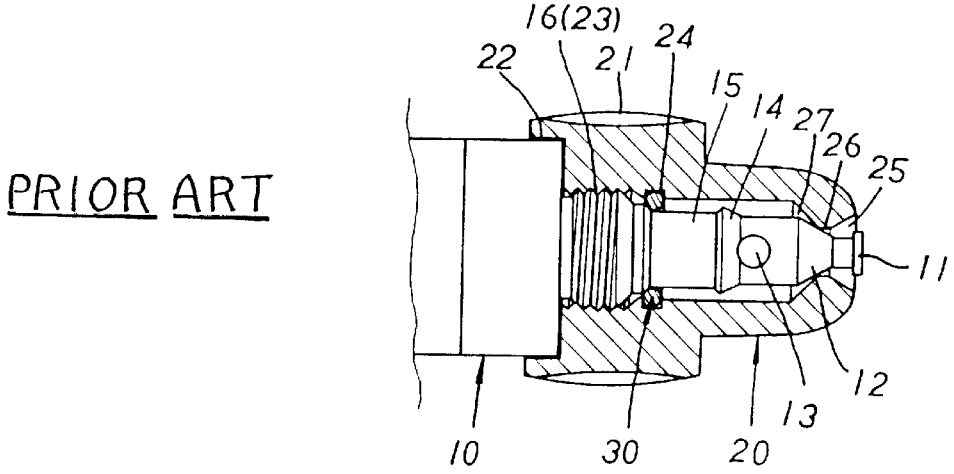
FIG. 2 is a sectional assembled view of the conventional rotary sprinkling head of sprinkling gun.
Figure 3:
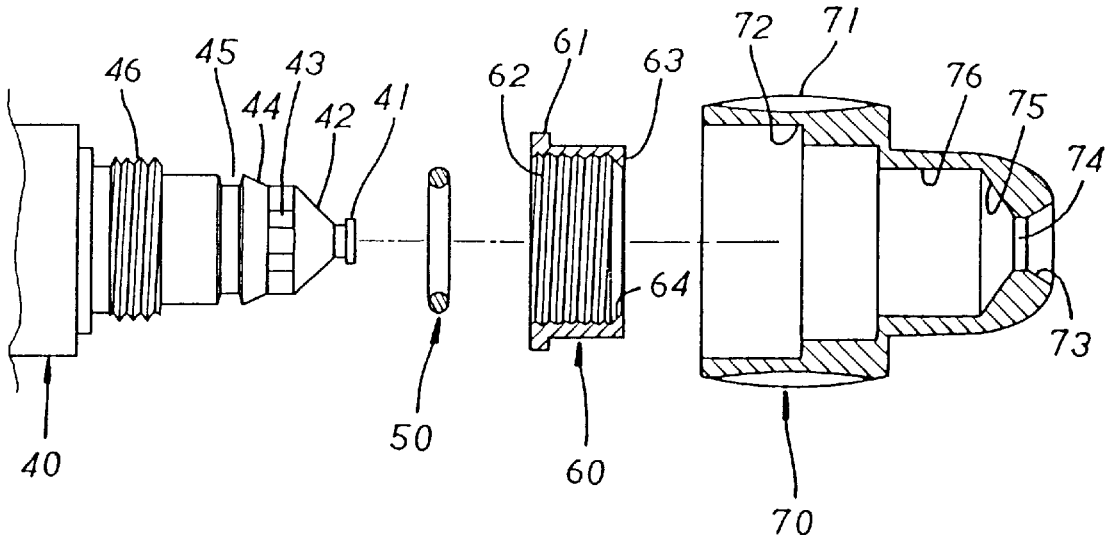
FIG. 3 is a sectional exploded view of the rotary sprinkling head of sprinkling gun of the present invention.

Please refer to FIG. 3. The rotary sprinkling head structure of the sprinkling gun of the present invention includes a gun body 40, an anti-detachment ring 50, an inner cap 60 and a rotary cap 70. The sprinkling head of the gun body 40 is made of plastic by integral injection molding. The front end of the sprinkling head is disposed with a nail head-like variable water discharging bead 41. A rearward diverging outer stop slope 42 is adjacent to rear side of the variable water discharging head 41. Several water exits 43 are formed behind the outer stop slope 42. A diverging slope guide face 44 is formed behind the water exits 43. An anti-detachment ring groove 45 is formed behind the slope guide face 44. An adjusting outer thread 46 is formed at the rear end of the sprinkling head. The inner cap 60 is made of plastic by integral injection molding. Several annular engaging ribs 61 are formed on the outer circumference of the rear section of the inner cap 60. An adjusting inner thread 62 is formed on inner circumference of the inner cap 60. An inward projecting stop section 63 is formed on inner circumference of front end of the inner cap 60. The diameter of the adjusting inner thread 62 is larger than the diameter of the stop section 63. A guide slope face 64 is formed between the stop section 63 and the adjusting inner thread 62. The rotary cap 70 is made of plastic by integral injection molding. The outer rear section of the rotary cap 70 is formed with a bulge rotary section 71. The interior of the rear section of the rotary cap 70 is formed with a two-step socket 72 with larger rear section and smaller front section. The front opening of the rotary cap 70 is formed with an outward diverging water discharging slope 73. A water sealing section 74 with unified smaller diameter is adjacent to rear side of the water discharging slope 73. A rearward diverging inner stop slope 75 is adjacent to the rear side of the water sealing section 74. A slide section 76 with a certain length is adjacent to the rear side of the inner stop slope 75.

Figure 4:
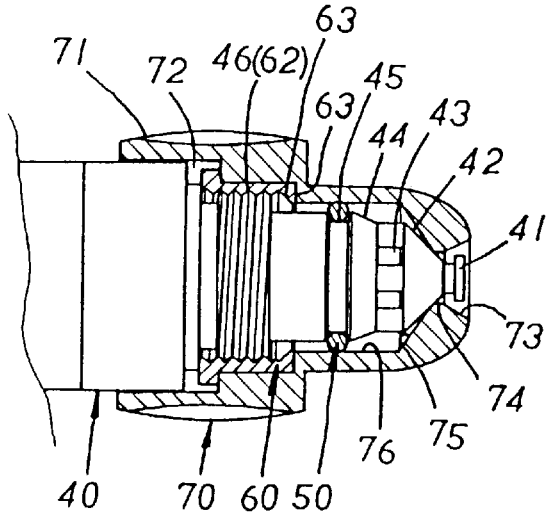
FIG. 4 is a sectional assembled view of the rotary sprinkling head of sprinkling gun of the present invention.

When assembled, referring to FIG. 4, the inner cap 60 is placed into the smaller section of the two-step socket 72 of rotary cap 70 with the engaging rib 61 of the inner cap 60 abutting against a shoulder section of the larger section of the socket 72. Then the inner cap 60 is fused with the rotary cap 70 by ultrasonic wave. Then the anti-detachment ring 50 is tightly fitted along the guide slope face 44 of the gun body 40 into the anti-detachment ring groove 45 of the sprinkling head. After the anti-detachment ring 50 is fitted into the anti-detachment ring groove 45, the outer diameter of this section is larger than the inner diameter of the stop section 63 of the front end section of the inner cap 60 to a certain extent. Then the rotary cap 70 together with the anti-detachment ring 50 is fitted onto the front end of the sprinkling head of the gun body 40 by applying a certain force thereonto. Accordingly, the stop section 63 of the front end section of the inner cap 60 is forcedly compressed and passed along the guide slope face 64 through the anti-detachment ring 50. Then the adjusting inner thread 62 of the inner cap 60 is screwed onto the adjusting outer thread 46 of the gun body 40 with the anti-detachment ring 50 attaching to the slide section 76 of the rotary cap 70.

According to the above arrangement, the present invention has the following advantages:

1. The anti-detachment ring 50 is fitted into the anti-detachment ring groove 45 of the gun body 40 to prevent the inner cap 60 and the rotary cap 70 from detaching therefrom. The anti-detachment ring groove 45 is formed on the outer circumference of the sprinkling head of the gun body 40 so that it is easier to complete the installation.
2. The sprinkling head of the gun body 40 and the inner cap 60 as well as the rotary cap 70 are all made of plastic by integral injection molding. Therefore, the processing time is shortened and mass-production is possible to lower cost.
3. The sprinkling head of the gun body 40 is made of plastic by integral injection molding with the anti-detachment ring groove 45 formed on the outer circumference of the sprinkling head. Such production measure has good precision and small error. Therefore, the anti-detachment ring 50 can be truly fitted into the anti-detachment ring groove 45 without detachment and the ratio of good product is high.

The above embodiment is only used to illustrate the present invention, not intended to limit the scope thereof. Many modifications of the above embodiment can be made without departing from the spirit of the present invention.

What is claimed is:

1. Rotary sprinkling head structure of sprinkling gun, comprising a gun body, an anti-detachment ring, an inner cap and a rotary cap, a front end of the sprinkling head being disposed with a variable water discharging head, an outer stop slope being adjacent to rear side of the variable water discharging head, several water exits being formed behind the outer stop slope, a slope guide face being formed behind the water exits, an adjusting outer thread being formed at the rear end of the sprinkling head, an outer rear section of the rotary cap being formed with a bulge rotary section, a front opening of the rotary cap being formed with an outward diverging water discharging slope, a water sealing section being adjacent to rear side of the water discharging slope, an inner stop slope being adjacent to the rear side of the water sealing section, said rotary sprinkling head structure being characterized in that the sprinkling head of the gun body is made of plastic by integral injection molding, an anti-detachment ring groove being formed behind the slope guide face, the inner cap being made of plastic by integral injection molding, an adjusting inner thread being formed on inner circumference of the inner cap, an inward projecting stop section being formed on inner circumference of front end of the inner cap, a guide slope face being formed between the stop section and the adjusting inner thread, the rotary cap being made of plastic by integral injection molding, an interior of the rear section of the rotary cap being formed with a socket, a slide section with a certain length being formed behind the inner stop slope, whereby when assembled, the inner cap is placed into the socket of rotary cap and the anti-detachment ring is tightly fitted into the anti-detachment ring groove of the sprinkling head, then the rotary cap together with the anti-detachment ring being fitted onto the front end of the sprinkling head of the gun body by applying a certain force thereonto, then the adjusting inner thread of the inner cap being screwed onto the adjusting outer thread of the gun body.

2. Rotary sprinkling head structure of sprinkling gun as claimed in claim 1, wherein the inner diameter of the adjusting inner thread of the inner cap is larger than the inner diameter of the stop section.

3. Rotary sprinkling head structure of sprinkling gun as claimed in claim 1, wherein after the anti-detachment ring is fitted into the anti-detachment ring groove of the gun body, the outer diameter of this section is larger than the inner diameter of the stop section of the inner cap.

4. Rotary sprinkling head structure of sprinkling gun as claimed in claim 1, wherein the socket of the rear section of the rotary cap is a two-step socket with larger rear section and smaller front section, whereby when the inner cap is received in the socket of the rotary cap, an engaging rib of the inner cap abuts against a shoulder section of the larger section of the socket.

5. Rotary sprinkling head structure of sprinkling gun as claimed in claim 1, wherein several annular engaging ribs are formed on the outer circumference of the rear end section of the inner cap.

* * * * *